US008669032B2

(12) United States Patent
Iwanaga et al.

(10) Patent No.: US 8,669,032 B2
(45) Date of Patent: Mar. 11, 2014

(54) ELECTROSTATIC-IMAGE-DEVELOPING TONER, PRODUCTION METHOD THEREOF, ELECTROSTATIC IMAGE DEVELOPER, AND IMAGE FORMING APPARATUS

(75) Inventors: Takeshi Iwanaga, Kanagawa (JP); Takahisa Fujii, Tokyo (JP); Masakazu Iijima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 646 days.

(21) Appl. No.: 12/556,306

(22) Filed: Sep. 9, 2009

(65) Prior Publication Data

US 2010/0248123 A1 Sep. 30, 2010

(30) Foreign Application Priority Data

Mar. 26, 2009 (JP) ..... 2009-076046

(51) Int. Cl.
*G03G 9/087* (2006.01)

(52) U.S. Cl.
USPC ..... 430/109.4; 430/45.54

(58) Field of Classification Search
USPC ..... 430/109.5, 45.54
See application file for complete search history.

(56) References Cited

U.S. PATENT DOCUMENTS

| | | | | |
|---|---|---|---|---|
| 2003/0129518 | A1 | 7/2003 | Sawada et al. | |
| 2003/0165766 | A1 | 9/2003 | Zhang et al. | |
| 2006/0057488 | A1* | 3/2006 | Inoue et al. | 430/109.4 |
| 2006/0160010 | A1 | 7/2006 | Patel et al. | |
| 2006/0216625 | A1 | 9/2006 | Maehata et al. | |
| 2007/0219313 | A1* | 9/2007 | Mizuhata et al. | 524/599 |
| 2007/0243478 | A1* | 10/2007 | Maeyama | 430/108.2 |
| 2008/0008944 | A1* | 1/2008 | Sato et al. | 430/48 |
| 2010/0297547 | A1 | 11/2010 | Hirota et al. | |

FOREIGN PATENT DOCUMENTS

| | | | |
|---|---|---|---|
| CN | 1723420 | A | 1/2006 |
| CN | 1808290 | A | 7/2006 |
| CN | 1837966 | A | 9/2006 |
| CN | 101101460 | A | 1/2008 |
| JP | A-2000-112172 | | 4/2000 |
| JP | A-2006-293338 | | 10/2006 |
| JP | A-2009-139588 | | 6/2009 |
| JP | WO2009/093592 | A1 | 7/2009 |
| JP | A-2010-061036 | | 3/2010 |

OTHER PUBLICATIONS

Japanese Office Action issued in Japanese Application No. 2009-076046 dated Aug. 9, 2011 (with translation).
Australian Office Action Dated Nov. 12, 2010 in Australian Patent Application No. 2009213532.
Mar. 27, 2013 Office Action issued in Chinese Application No. 200910176006.3 with English translation).
Dec. 14, 2012 Office Action issued in Korean Patent Application No. 10-2009-0086880 (with English translation).

* cited by examiner

*Primary Examiner* — Mark F Huff
*Assistant Examiner* — Rachel Zhang
(74) *Attorney, Agent, or Firm* — Oliff PLC

(57) ABSTRACT

An electrostatic-image-developing toner includes a binder resin that contains a crystalline polyester resin and an amorphous polyester resin; and a coloring agent, wherein the crystalline polyester resin has a melting temperature Tmc of about 25° C. or greater but not greater than about 50° C., and a content of the crystalline polyester resin in the electrostatic-image-developing toner is about 3 wt % or greater but not greater than about 15 wt. %.

15 Claims, 1 Drawing Sheet

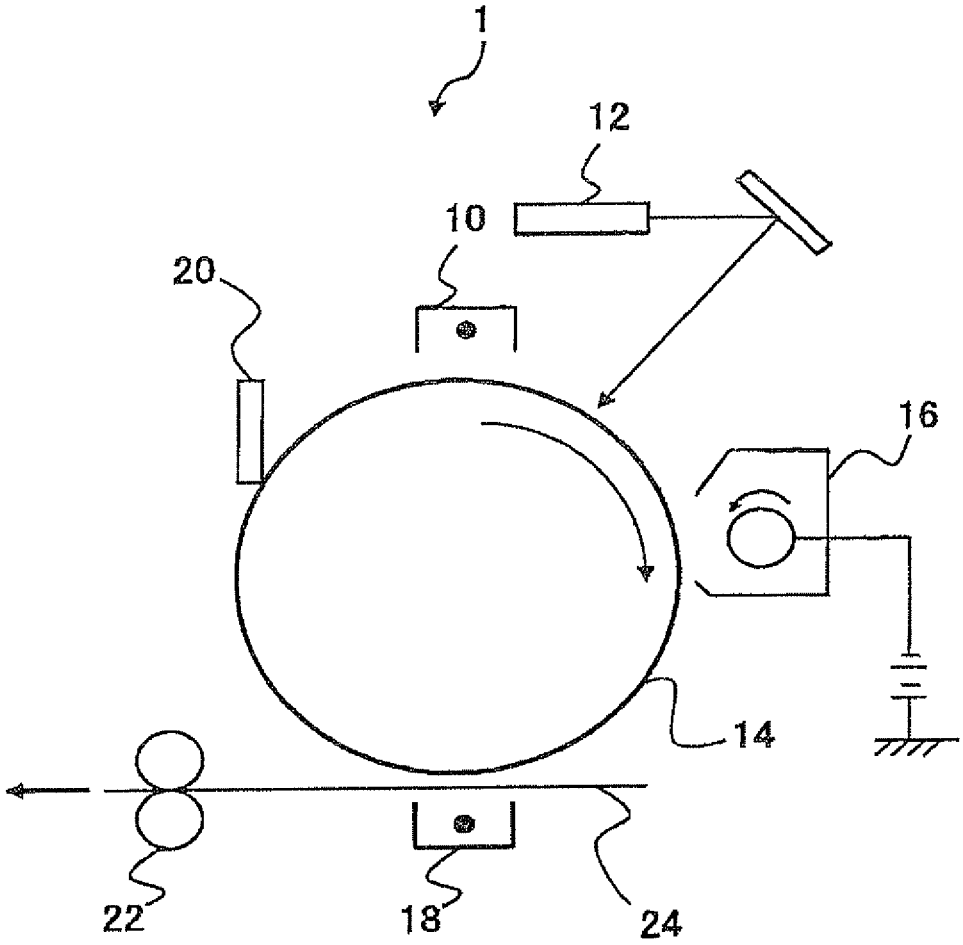
1
12
10
20
16
14
22
18
24

ELECTROSTATIC-IMAGE-DEVELOPING TONER, PRODUCTION METHOD THEREOF, ELECTROSTATIC IMAGE DEVELOPER, AND IMAGE FORMING APPARATUS

CROSS-REFERENCE TO RELATED APPLICATIONS

This application is based on and claims priority under 35 USC 119 front Japanese Patent Application No. 2009-076046 filed on Mar. 26, 2009.

BACKGROUND

1. Technical Field

The present invention relates to an electrostatic-image-developing toner, a production method thereof, an electrostatic image developer, and an image forming apparatus.

2. Related Art

Methods of visualizing image information via an electrostatic image such as electrophotographic method have been utilized in various fields recently. In the electrophotographic method, an electrostatic latent image is formed on an image holding member through charging and exposure steps (latent image formation step), the electrostatic latent image is developed with an electrostatic image developer (which may hereinafter be called "developer", simply) containing an electrostatic-image-developing toner (which may hereinafter be called "toner", simply), and the image is visualized through transfer and fixing steps, As the developer used herein, a two-component developer composed of a toner and a carrier and a one-component developer using only a magnetic toner or a nonmagnetic toner are known. The toner is typically produced by a kneading grinding method. In this method, a binder resin such as thermoplastic resin is melted and kneaded together with a coloring agent such as pigment, a charge controlling agent, and a releasing agent such as wax and the resulting mixture is then cooled, ground and classified.

As a method capable of intentionally controlling the shape and surface structure of the toner to satisfy a demand for improving the image quality, a production method of a toner using the wet process is proposed. In particular, suspension polymerization method, emulsion polymerization aggregation method, and the like are methods for producing toner particles having a particle size as uniform as possible in order to achieve a high image quality.

In addition, as the wet process, a solution suspension method of dispersing and suspending a binder resin and a coloring agent, which have been dissolved or dispersed in advance in an organic solvent, in an aqueous medium and then removing the organic solvent from the suspension by heating or pressure reduction to obtain toner particles is known. This production process is advantageous in that it provides toner particles having a highly uniform particle size, leaves almost no monomer in the toner, and does not require use of a surfactant.

SUMMARY

According to an aspect of the invention, there is provided an electrostatic-image-developing toner including a binder resin that contains a crystalline polyester resin and an amorphous polyester resin; and a coloring agent, wherein the crystalline polyester resin has a melting temperature Tmc of about 25° C. or greater but not greater than about 50° C., and a content of the crystalline polyester resin in the electrostatic-image-developing toner is about 3 wt % or greater but not greater than about 15 wt. %.

BRIEF DESCRIPTION OF THE DRAWINGS

Exemplary embodiment(s) of the present invention will be described in detail based on the following figures, wherein FIG. 1 is a schematic structural view illustrating one example of an image forming apparatus according to the exemplary embodiment of the invention.

wherein

1 denotes Image forming apparatus, 10 denotes Charging portion, 12 denotes Exposure portion, 14 denotes Electrophotographic photoreceptor, 16 denotes Developing portion, 18 denotes Transfer portion, 20 denotes Cleaning portion, 22 denotes Fixing portion, and 24 denotes Transfer-receiving material.

DETAILED DESCRIPTION

The exemplary embodiments of the invention will hereinafter be described. The present exemplary embodiments are only examples for carrying out the invention and the invention is not limited to or by them.

<Electrostatic-Image-Developing Toner>

The electrostatic-image-developing according to the exemplary embodiment includes a binder resin containing a crystalline polyester resin and an amorphous polyester resin, and a coloring agent. In the toner according to the exemplary embodiment, the melting temperature Tmc of the crystalline polyester resin is 25° C. or greater but not greater than 50° C., or about 25° C. or greater but not greater than about 50° C. and the content of the crystalline polyester resin in the toner is 3 wt. % or greater but not greater than 15 wt. %, or about 3 wt. % or greater but not greater than about 15 wt. %.

As a production method of the electrostatic-image-developing toner, a variety of chemical toner production methods such as suspension polymerization method and solution suspension method as well as emulsion polymerization aggregation method have been developed and they have been carried out instead of the conventional kneading grinding method. In the solution suspension method, toner particles are obtained by dispersing and suspending, in an aqueous medium, a binder resin or a coloring agent preliminarily dissolved or dispersed in an organic solvent and removing the organic solvent from the suspension by heating or pressure reduction.

Since the solution suspension method uses an organic solvent in an aqueous medium, the organic solvent component used for dissolving or dispersing the binder resin sometimes remains inside the toner. With a recent increase in the speed of image forming apparatuses such as copying machine, the temperature of a developing machine tends to increase under high agitation conditions particularly in a high-speed developing machine. When the temperature of the toner increases at this time, the solvent component remaining in the toner tends to ooze out from the toner surface, and the solvent component sometimes precipitates on the toner surface, influenced by an agitation stress of the developing machine. As a result, toner particles may adhere to each other with a solvent to form an aggregate or toner filming may occur on a photoreceptor and cause a photoreceptor crack.

In the toner according to the exemplary embodiment, the crystalline polyester resin used therefor has a melting temperature Tmc of 25° C. or greater but not greater than 50° C., or about 25° C. or greater but not greater than about 50° C. and the content of the crystalline polyester resin in the toner is 3 wt. % or greater but not greater than 15 wt. %, or about 3 wt. % or greater but not greater than about 15 wt. % so that the internal temperature of the toner during the drying step upon toner production tends to become the melting temperature Tmc of the crystalline polyester resin or greater and the crystalline polyester resin component tends to melt and move to the surface of toner particles. As a result, a drying efficiency from the surface of the toner particles increases, leading to a decrease in the solvent component remaining inside the toner.

The melting temperature Tmc of the crystalline polyester resin used for the toner is 25° C. or greater but not greater than 50° C., or about 25° C. or greater but not greater than about 50° C., preferably 30° C. or greater but not greater than 45° C., or about 30° C. or greater but not greater than about 45° C. When the melting temperature Tmc is less than 25° C., the crystalline polyester resin softens even at normal temperature and moves too actively in the toner during the drying step, resulting in prominent appearance, from the surface, of the crystalline polyester resin and also the solvent component remaining inside the toner. In addition, appearance of the crystalline polyester resin from the toner surface occurs due to an agitation stress of a developing machine, leading to fusing of toner particles and toner filming on a photoreceptor. When the melting temperature Tmc exceeds 50° C., on the other hand, the solvent component remaining inside the toner increases due to a small drying assistance effect during the drying step and precipitates on the toner surface due to a temperature rise caused by agitation in the developing machine of a high-speed image forming apparatus, resulting in occurrence of toner filming on the photoreceptor or cracks of the photoreceptor.

A total content of the crystalline polyester resin in the toner falls within a range of 3 wt. % or greater but not greater than 15 wt. %, or about 3 wt. % or greater but not greater than about 15 wt. %, preferably 5 wt. % or greater but not greater than 9 wt. %, or about 5 wt. % or greater but not greater than about 9 wt. %. When the content is less than 3 wt. %, the drying assistance effect is small and the low-temperature fixing property cannot be maintained. When the content exceeds 15 wt. %, on the other hand, a softened portion in the toner increases. Although the remaining solvent component is removed in the drying step, appearance of the crystalline polyester resin from the toner surface becomes prominent, making it difficult to control the charging property and easily causing fogging in the background portion of the image (background fogging).

The acid value AVc of the crystalline polyester resin falls within a range of preferably 5 mgKOH/g or greater but not greater than 20 mgKOH/g, or about 5 mgKOH/g or greater but not greater than about 20 mgKOH/g, more preferably 6 mgKOH/g or greater but not greater than 15 mgKOH/g, or about 6 mgKOH/g or greater but not greater than about 15 mgKOH/g. The acid values within the above range enable to suppress toner filming further while maintaining the low-temperature fixing property of the toner. When the acid value AVc of the crystalline polyester resin is less than 5 mgKOH/g, the crystalline polyester resins form an aggregate, making it difficult to produce a structure with a releasing agent. In addition, the crystalline polyester resin sometimes appears from the toner surface as a result of independent presence or large growth of the crystalline polyester resin particles in the toner so that the acid value below the above range is sometimes not preferred from the viewpoint of the flowability and charging property of the toner. When the acid value AVc of the crystalline polyester resin exceeds 20 mgKOH/g, on the other hand, it is sometimes impossible to construct a stable structure due to difficulty in enclosing the resin in the toner.

The acid value Ava of the amorphous polyester resin falls within a range of preferably 10 mgKOH/g or greater but not greater than 20 mgKOH/g, or about 10 mgKOH/g or greater but not greater than about 20 mgKOH/g, more preferably 12 mgKOH/g or greater but not greater than 18 mgKOH/g, or about 12 mgKOH/g or greater but not greater than about 18 mgKOH/g. When the acid value AVa of the amorphous polyester resin is less than 10 mgKOH/g, a repulsive force with a hydrophobic material inside the toner is generated, which may lead to a domain structure. When the acid value AVa of the amorphous polyester resin exceeds 20 mgKOH/g, on the other hand, environment dependence of a charging ability may rise due to an increase in hydrophilicity.

The glass transition temperature (Tg) of the amorphous polyester resin falls within a range of preferably 40° C. or greater but not greater than 60° C., or about 40° C. or greater but not greater than about 60° C., more preferably 45° C. or greater but not greater than 55° C., or about 45° C. or greater but not greater than about 55° C. The glass transition temperatures within the above range enable to suppress toner filming further without deteriorating the low-temperature fixing property of the toner. Glass transition temperatures Tg of the amorphous polyester resin below 40° C. may lead to insufficient heat storage property, while those exceeding 60° C. may impair the low-temperature fixing property.

The toner according to the exemplary embodiment is a toner having a low-temperature fixing property and it includes a binder resin containing a crystalline polyester resin and an amorphous polyester resin, and a coloring agent.

In the exemplary embodiment, the term "crystalline" of the crystalline polyester resin means that in differential scanning calorimetry (DSC) of a resin or toner, it shows not a stepwise endothermic change but a clear endothermic peak. Described specifically, in differential scanning calorimetry (DSC) using a differential scanning calorimeter ("DSC-60", product name) manufactured by Shimadzu Corporation and equipped with an automatic tangent line processing system, a resin or toner having a temperature difference within 10° C. from an onset temperature to a peak top of the endothermic peak when heated at a temperature elevation rate of 10° C./min is regarded to have a clear endothermic peak. From the viewpoint of a sharp melting property, the temperature difference from the onset temperature to the peak top of the endothermic peak is preferably within 10° C., more preferably within 6° C. An arbitrary point at the flat part of the base line in the DSC curve and an arbitrary point at the flat part of the rising part from the base line are specified and a point of intersection of tangent lines of the flat parts between these points is determined automatically as the "onset temperature" by the automatic tangent line processing system. The term "endothermic peak" may indicate a peak of the resulting toner having a width of 40° C. or greater but not greater than 50° C.

The term "amorphous polyester resin" to be used as the binder resin" means a resin having a temperature difference from the onset temperature to the peak top of the endothermic peak, in differential scanning calorimetry (DSC) of the resin or toner, exceeding 10° C. or a resin showing no clear endothermic peak. Described specifically, in differential scanning calorimetry (DSC) using a differential scanning calorimeter ("DSC-60", product name) manufactured by Shimadzu Corporation and equipped with an automatic tangent line processing system, a resin having a temperature difference exceeding 10° C. from an onset temperature to a peak top of an endothermic peak when heated at a temperature elevation rate of 10° C./min or having no clear endothermic peak is designated as an amorphous resin. The temperature from the onset temperature to the peak top of the endothermic peak preferably exceeds 12° C. It is more preferred that no clear endothermic peak is observed. The onset temperature in the DSC curve is determined in a similar manner to that employed in the "crystalline polyester resin".

The composition of the crystalline polyester resin to be used in the exemplary embodiment is not limited insofar as it has, as described above, a melting temperature Tmc of 25° C. or greater but not greater than 50° C., or about 25° C. or greater but not greater than about 50° C. The crystalline polyester resin is preferred from the standpoint of adhesion property to paper during fixing, charging property, and adjustment of a melting temperature within a preferable range. Aliphatic crystalline polyester resins having an adequate melting temperature are more preferred. Specific examples of the crystalline polyester resin preferably employed will next be described.

The crystalline polyester resin is synthesized from an acid (dicarboxylic acid) component and an alcohol (diol) component. In the exemplary embodiment, the "acid-derived component" means a moiety which is an acid component before synthesis of a polyester resin, while the term "alcohol-derived component" means a moiety which is an alcohol component before synthesis of the polyester resin.

When the polyester resin is not crystalline, meaning that the resin is amorphous, it tends to fail to achieve toner blocking resistance and image storage property while maintaining good low-temperature fixing property. A polymer obtained by copolymerizing the crystalline polyester main chain with another component and containing said another component in an amount not greater than 50 wt. % is also called a crystalline polyester resin.

[Acid-Derived Component]

The acid-derived component is preferably an aliphatic dicarboxylic acid, especially preferably a linear carboxylic acid. Examples include, but not limited to oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, lower alkyl esters and acid anhydrides thereof. Of these aliphatic dicarboxylic acids, sebacic acid and 1,10-decanedicarboxylic acid are preferred in view of availability.

In addition to the component derived from the aliphatic dicarboxylic acid, the acid derived component preferably contains a component such as a dicarboxylic-acid derived component having a double bond and a dicarboxylic-acid derived component having a sulfonic acid group. The above dicarboxylic-acid derived component having a double bond includes, in addition to components derived from a dicarboxylic acid having a double bond, components derived from lower alkyl esters or acid anhydrides of a dicarboxylic acid having a double bond. Further, the above dicarboxylic-acid derived component having a sulfonic acid group includes, in addition to components derived from a dicarboxylic acid having a sulfonic acid group, components derived from lower alkyl esters or acid anhydrides of a dicarboxylic acid having a sulfonic acid group.

The dicarboxylic acid having a double bond is suitably used for preventing hot offset during fixing because it can crosslink the entire resin by making use of its double bond. Examples of such a dicarboxylic acid include, but not limited to, fumaric acid, maleic acid, 3-hexenedioic acid, and 3-octenedioic acid. Lower alkyl esters and acid anhydrides thereof are also usable. Of these, fumaric acid and maleic acid are preferred from the standpoint of cost.

The sulfonic-acid-containing dicarboxylic acid is effective because it improves dispersion of the coloring agent such as pigment. If a sulfonic acid group is present upon emulsifying or suspending the entire resin in water to prepare particles, a surfactant is not necessary as described later. Examples of the sulfonic-acid-containing dicarboxylic acid include, but not limited to, sodium 2-sulfoterephthalate, sodium 5-sulfoisophthalate, and sodium sulfosuccinate. Lower alkyl esters and acid anhydrides thereof are also usable. Of these, sodium 5-sulfoisophthalate is preferred from the standpoint of cost.

The content of these acid-derived components (dicarboxylic-acid derived components having a double bond and/or dicarboxylic-acid derived components having a sulfonic acid group) other than the aliphatic-dicarboxylic-acid derived components in the acid-derived components is preferably 1 mol % by constitution or greater but not greater than 20 mol % by constitution, more preferably 2 mol % by constitution or greater but not greater than 10 mol % by constitution.

When the content is less than 1 mol % by constitution, aggregation due to poor pigment dispersion or increase in the emulsion particle size may make it difficult to control the toner particle size. When the content exceeds 20 mol % by constitution, oft the other hand, a decrease in the crystallinity of the polyester resin and a drop in melting temperature may deteriorate the storage stability of the image or dissolution in water due to an excessively small emulsion particle size may prevent the formation of a latex. It is to be noted that the term "mol % by constitution" as used herein means a percentage supposing that the amount of each component (acid-derived component, alcohol-derived component) in the polyester resin is one unit (mol),

[Alcohol-Derived Component]

As the alcohol-derived component, aliphatic diols are preferred. Examples include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Of the aliphatic diols, 1,9-nonanediol and 1,10-decanediol are preferred from the standpoint of the melting temperature of the resin and resistance.

The alcohol-derived component contains the aliphatic-diol-derived component in an amount of preferably 80 mol % by constitution or greater and it may contain another component as needed. The alcohol-derived component contains the aliphatic-diol-derived component in an amount of preferably 90 mol % or greater by constitution.

When the content is less than 80 mol % by constitution, toner blocking resistance, the crystallinity of the polyester resin decreases and its melting point lowers, which may result in deterioration in toner blocking resistance, image storage property, and low-temperature fixing property. Examples of said another component to be contained as needed include diol-derived components having a double bond and diol-derived components having a sulfonic acid group.

Examples of the diol having a double bond include 2-butene-1,4-diol, 3-butene-1,6-diol, and 4-butene-1,8-diol. Examples of the diol having a sulfonic acid group include 1,4-dihydroxy-2-sulfonic acid benzene sodium salt, 1,3-dihydroxymethyl-5-sulfonic acid benzene sodium, and 2-sulfo-1,4-butanediol sodium salt.

When an alcohol-derived component other than these linear aliphatic diol-derived component is added, the content of the diol-derived component having a double bond and/or the diol-derived component having a sulfonic acid group in the alcohol-derived component is preferably 1 mol % by constitution or greater but not greater than 20 mol % by constitution, more preferably 2 mol % by constitution or greater but not greater than 10 mol % by constitution. When the content is less than 1 mol % by constitution, it may become difficult to adjust the toner size because aggregation occurs due to insufficient dispersion of the pigment or an increase in the emulsion particle size. Contents exceeding 20 mol % bby constitution, on the other hand, may decrease the crystallinity of the polyester resin, reduce the melting point, and deteriorate the storage stability of images or they may lead to failure in the generation of a latex because emulsion particles dissolve in water due to excessively small particle size.

No particular limitation is imposed on the production method of the polyester resin and it may be produced by the conventional polyester polymerization method in which an acid component and an alcohol component are reacted with each other. For example, direct polycondensation and ester exchange reaction may be employed. The method may be selected depending on the kind of the monomer. A molar ratio of the acid component to the alcohol component (acid component/alcohol component) upon reaction differs depending on the reaction conditions and the like and cannot be said in a wholesale manner, but is usually about 1/1.

The production of the polyester resin may be performed, for example, at a polymerization temperature of 180° C. or greater but not greater than 230° C. The reaction may be effected while reducing the pressure in the reaction system and removing water or alcohol generated during the condensation if necessary. When the monomer is not soluble or compatible under the reaction temperature, a solvent having a high boiling temperature may be added as a solubilizing aid prior to dissolution. The polycondensation reaction may be performed while distilling off the solvent added as a solubilizing aid. When there is a monomer having poor compatibility in the copolymerization reaction, the monomer having poor compatibility may be condensed with an acid or alcohol to be polycondensed with the monomer and then, the condensate may be polycondensed with the main component Examples of the catalyst which may be used upon production of the polyester resin include compounds of an alkali metal such as sodium or lithium, compounds of an alkaline earth metal such as magnesium or calcium, compounds of a metal such as zinc, manganese, antimony, titanium, tin, zirconium or germanium, phosphorous acid compounds, phosphoric acid compounds, and amine compounds.

In order to adjust the melting temperature, molecular weight, and the like of the crystalline polyester resin which is a main component of the binder resin in the exemplary embodiment, a compound having a short-chain alkyl group, alkenyl group, aromatic ring, or the like may be added, in addition to the foregoing polymerizable monomers. Specific examples thereof include, when the compound is a dicarboxylic acid, alkyl dicarboxylic acids such as succinic acid, malonic acid, and oxalic acid, aromatic dicarboxylic acids such as phthalic acid, isophthalic acid, terephthalic acid, homophthalic acid, 4,4'-bibenzoic acid, 2,6-naphthalenedicarboxylic acid, and 1,4-naphthalenecarboxylic acid, and nitrogen-containing aromatic dicarboxylic acids such as dipicolinic acid, dinicotinic acid, quinolinic acid, and 2,3-pyrazinedicarboxylic acid; when the compound is a diol, short-chain alkyl diols such as succinic acid, malonic acid, acetonedicarboxylic acid, and diglycolic acid; when the compound is a short-chain alkyl vinyl polymerizable monomer, short-chain alkyl/alkenyl(meth)acrylates such as methyl (meth)acrylate, ethyl(meth)acrylate, propyl(meth)acrylate, and butyl(meth)acrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, butadiene, and isoprene. These polymerizable monomers may be used either singly or in combination.

In the exemplary embodiment, compounds having a hydrophilic polar group may be used insofar as they are copolymerizable as a resin for the electrostatic-image-developing toner. Specific examples include, when a polyester resin is employed as the resin, dicarboxylic acid compounds having an aromatic ring directly substituted with a sulfonyl group such as sodium sulfonyl terephthalate and sodium 3-sulfonyl isophthalate; when a vinyl resin is employed as the resin, unsaturated aliphatic carboxylic acids such as (meth) acrylic acid and itaconic acid, esters between (meth)acrylic acid and an alcohol such as glycerin mono(meth)acrylate, fatty acid-modified glycidyl (meth)acrylate, zinc mono(meth)acrylate, zinc di(meth) acrylate, 2-hydroxyethyl (meth) acrylate, polyethylene glycol (meth)acrylate, and polypropylene glycol (meth) acrylate, styrene derivatives having, at an ortho, meta or para position thereof, a sulfonyl group, and sulfonyl-substituted aromatic vinyl compounds such as sulfonyl-containing vinyl naphthalene.

The crystalline polyester resin in the exemplary embodiment may further contain a crosslinking agent it necessary in order to prevent uneven gloss, uneven coloration, hot offset and the like during fixing in the high-temperature region. Specific examples of the crosslinking agent include trivalent or higher valent aromatic or aliphatic compounds such as trimellitic acid. Compounds having, in one molecule thereof, at least three, in total, of a hydroxyl group and a carboxyl group such as hydroxyphthalic acid, hydroxyisophthalic acid and hydroxyterephthalic acid may be used. Anhydrides of such a carboxylic acid or alkyl esters of such a carboxylic acid may also be employed.

In the case of the polyester resin, a method of copolymerizing an unsaturated polycarboxylic acid such as fumaric acid, maleic acid, itaconic acid, or trans-aconitic acid in the polyester and then crosslinking by using the multiple bond portions in the resin or by using another vinyl compound. In the exemplary embodiment, these crosslinking agents may be used either singly or in combination.

In the crosslinking method with the above crosslinking agents, the polymerizable monomers may be polymerized and crosslinked with the crosslinking agent upon polymerization: or after polymerization of the resin or production of a toner while leaving the unsaturated portion in the resin, the unsaturated portion may be crosslinked via a crosslinking reaction.

The polymerizable monomers of the crystalline polyester resin may be polycondensed into a polymer. As the catalyst for the polycondensation, known ones may be used. Specific examples include titanium tetrabutoxide, dibutyltin oxide, germanium dioxide, antimony trioxide, tin acetate, zinc acetate, and tin disulfide.

Polymerization initiators for crosslinking the unsaturated portion via the crosslinking reaction are not particularly limited. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenyl peracetate hydroperoxide, tert-butyl performate, tert-butyl peracetate, tert-butyl perbenzoate, tert-butyl phenyl peracetate, tert-butyl methoxyperaceate and tert-butyl N-(3-toluyl percarbamate; azo compounds such as 2,2'-azobispropane, 2,2'dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutylonitrile, methyl 2,2'-azobis-2-methylpropionate, 2,2'-dichloro-2,2'-azobisbutane, 2,2'-azobis-2-methylbutylonitrile, dimethyl 2,2'-azobisisobutyrate, 1,1'-azobis(sodium 1-methyl butylonitrile-3-sulfonate), 2-(4-methylphenylazo)-2-methylmalonodinitrile, 4,4'-azobis-4-cyanovaleric acid, 3,5-dihydxoxymethylphenylazo-2-methylmalonodinitrile, 2-(4-bromophenylazo)-2-allylmalononitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenolA-4,4'-azobis-4-cyanopentanoate), and poly(tetraethyleneglycol-2,2'-azobisisobutyrate); 1,4-bis(pentaethylene)-2-tetrazene and 1,4-dimethoxycarbonyl-1,4-diphenyl-2-tetrazene.

The polymerization initiator may be used as an initiator of the crosslinking reaction in the above crosslinking step.

The crystalline polyester resin has a weight average molecular weight (Mw) of preferably 10,000 or greater but not greater than 30,000, or about 10,000 or greater but not greater than about 30,000, more preferably 20,000 or greater but not greater than 30,000, or about 20,000 ox greater but not greater than about 30,000. The Mw less than 10,000 may cause deterioration in image durability and deterioration in enclosing property due to an increase in acid value. The Mw exceeding 30,000, on the other hand, may deteriorate the compatibility of the amorphous polyester resin. The crystalline polyester resin has a number-average molecular weight (Mn) of preferably 2,000 or greater, more preferably 4,000 or greater. When the number average molecular weight (Mn) is less than 2,000, the toner may penetrate into the surface of a recording medium such as paper during fixing and may cause uneven fixing or deterioration in the bending resistance of a fixed image.

The amorphous polyester resin has a weight-average molecular weight (Mw) of 10,000 or greater but not greater than 50,000, or about 10,000 or greater but not greater than about 50,000, more preferably 15,000 or greater but not greater than 45,000, or about 15,000 or greater but not greater than about 45,000. The Mw less than 10,000 may cause the offset at the time of high-temperature fixing or deterioration in the image intensity. The Mw exceeding 50,000, on the other hand, may deteriorate the low-temperature fixing property or deteriorate the gloss of the fixed image. The number average molecular weight (Mn) of the amorphous polyester resin is preferably 5,000 or greater but not greater than 40,000, more preferably 8,000 or greater but not greater than 35,000 The Mn less than 5,000 may cause deterioration in the intensity of the fixed image. The Mn exceeding 40,000, on the other hand, may deteriorate the low-temperature fixing property or deteriorate the gloss of the fixed image.

The toner according to the exemplary embodiment preferably contains, as the binder resin, a urea-modified polyester resin available by a reaction between an isocyanate-containing polyester resin (polyester prepolymer) and an amine. Incorporation of the urea-modified polyester resin in the toner enables to improve the enclosing property of the releasing agent and suppress toner filming further. The content of the urea-modified polyester resin in the toner is preferably 10 wt. % or greater but not greater than 50 wt. %, more preferably 15 wt. % or greater but not greater than 40 wt %. Such contents enable to control the enclosing property of the releasing agent more preferably and prevent generation of background fogging and toner filming on a photoreceptor.

As the polyester prepolymer, a polycondensate between an acid (dicarboxylic acid) component and an alcohol (diol) component obtained by reacting a polyester having active hydrogen with a polyisocyanate is usable. Examples of an active-hydrogen-containing group of the polyester include hydroxyl groups (alcoholic hydroxyl group and phenolic hydroxyl group), an amino group, a carboxyl group, and a mercapto group. Of these, the alcoholic hydroxyl group is more preferred.

The term "modified polyester" means a polyester resin having a binding group other than an ester bond or a polyester resin having therein a resin component, which is different therefrom in constitution, connected via a covalent bond or an ionic bond. For example, it means a polyester having an end reacted with a bond or group other than the ester bond. Specific examples include a polyester resin having an end modified by introducing thereinto a functional group such as isocyanate group, which reacts with an acid group or a hydroxyl group, and reacting with an active hydrogen compound further.

Examples of the acid (dicarboxylic acid) component and alcohol (diol) component in the polyester prepolymer are similar to the above examples of the acid (dicarboxylic acid) component and alcohol (diol) component in the crystalline polyester resin.

Examples of the polyisocyanate include aliphatic polyvalent isocyanates (such as tetramethylene diisocyanate, hexamethylene diisocyanate, and 2,6-diisocyanate methylcaproate); alicyclic polyisocyanates (such as isophorone diisocyanate and cyclohexylmethane diisocyanate); aromatic diisocyanates (such as tolylene diisocyanate and diphenylmethane diisocyanate); aromatic aliphatic diisocyanates (such as $\alpha,\alpha,\alpha',\alpha'$-tetramethylxylylene diisocyanate); isocyanurates; compounds formed by blocking the above polyisocyanates with a phenol derivative, oxime, caprolactam, or the like; and a combination of at least two of these compounds.

A ratio of the polyisocyanate is, in terms of an equivalent ratio [NCO]/[OH] between the isocyanate group [NCO] and the hydroxyl group [OH] of the hydroxyl-containing polyester, preferably 1/1 or greater but not greater than 5/1, or, about 1/1 or greater but not greater than about 5/1, more preferably 1.2/1 or greater but not greater than 4/1, or about 1.2/1 or greater but not greater than about 4/1, still more preferably 1.5/1 or greater but not greater than 2.5/1, or about 1.5/1 or greater but not greater than about 2.5/1. The [NCO]/[OH] ratio exceeding 5 may deteriorate the low-temperature fixing property. When the molar ratio of [NCO] is less than 1, on the other hand, the content of urea in the modified polyester decreases, which may lead to deterioration in the hot offset resistance. The content of the polyisocyanate component in the polyester prepolymer having, at the end thereof, isocyanate groups is preferably 0.5 wt. % or greater but not greater than 40 wt %, more preferably 1 wt % or greater but not greater than 30 wt. %, still more preferably 2 wt. % or greater but not greater than 20 wt. %. Contents less than 0.5 wt. % may deteriorate the hot offset resistance and at the same time, may become disadvantageous in satisfying both heat-resistant storage property and low-temperature fixing property. Contents exceeding 40 wt. %, on the other hand, may deteriorate the low-temperature fixing property.

The average number of isocyanate groups contained per molecule of the polyester prepolymer having isocyanate groups is preferably 10 or greater, more preferably 1.5 or greater but not greater than 3, still more preferably 1.8 or greater but not greater than 2.5. When the number per molecule is less than 1, the molecular weight of the modified polyester after crosslinking and/or elongation may decrease, causing deterioration in hot offset resistance.

Examples of the amine include diamines, polyamines having three or more amino groups, amino alcohols, amino mercaptans, amino acids, and these amines with a blocked amino group.

Examples of the diamines include aromatic diamine (such as phenylenediamine, diethyltoluenediamine, and 4,4'-diaminodiphenylmethane), alicyclic diamines (such as 4,4'-diamino-3,3'-dimethyldicyclohexylmethane, diaminecyclohexane, and isophoronediamine); and aliphatic diamines (such as ethylenediamine, tetramethylenediamine, and hexamethylenediamine). Examples of the polyamines having three or more amino groups include diethylenetriamine and triethylenetetramine. Examples of amino alcohols include ethanolamine and hydroxyethyl aniline. Examples of the amino mercaptans include aminoethyl mercaptan and aminopropyl mercaptan. Examples of the amino acids include aminopropionic acid and aminocaproic acid. Examples of these amines with a blocked amino group include ketimine compounds obtained from amines such as diamines, polyamines having three or more amino groups, amino alcohols, amino mercaptans, and amino acids and ketones (such as acetone, methyl ethyl ketone, and methyl isobutyl ketone) and oxazoline compounds. Of these amines, the ketimine compounds are preferred.

Moreover, the molecular weight of the modified polyester after completion of the reaction can be controlled by adjusting the crosslinking or elongation reaction with a reaction terminator. Examples of the reaction terminator include monoamines (such as diethylamine, dibutylamine, butylamine, and laurylamine) and blocked compounds thereof (ketimine compounds).

A ratio of the amines is, in terms of an equivalent ratio $[NCO]/[NH_x]$ between the isocyanate group [NCO] in the polyester prepolymer having isocyanate groups and the amino group $[NH_x]$ in the amines, preferably 1/2 or greater but not greater than 2/1, more preferably 1.5/1 or greater but riot greater than 1/1.5, still more preferably 1.2/1 or greater but not greater than 1/1.2. When the $[NCO]/[NH_x]$ exceeds 2 or is below 1/2, the molecular weight of urea-modified polyester resin may decreases, leading to deterioration of hot offset resistance.

The urea-modified polyester resin is produced, for example, by a method such as one-shot method or prepolymer method. The weight-average molecular weight of the urea-modified polyester resin is preferably 10,000 or greater, more preferably 20,000 or greater but not greater than 10,000,000, still more preferably 30,000 or greater but not greater than 1,000,000. The peak molecular weight at this time is preferably 1,000 or greater but not greater than 10,000. When the peak molecular weight is below 1,000, the elongation reaction does not proceed smoothly and the toner cannot have sufficient elasticity, which may result in deterioration of hot offset resistance. When it exceeds 10,000, on the other hand, deterioration in fixing property or necessity of high level of grinding or pulverization upon production may occur. No particular limitation is imposed on the number-average molecular weight of the urea-modified polyester resin and it may be a number-average molecular weight which facilitates achievement of the above weight average molecular weight.

Although the coloring agent to be used for the toner of the exemplary embodiment may be either a dye or a pigment, a pigment is preferred from the standpoint of light resistance and water resistance. Preferred examples of the pigment include known pigments such as Carbon Black, Aniline Black, Aniline Blue, Chalcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, Quinacridone, Benzidine Yellow, C.I. Pigment Red 48:1, C.I. Pigment Red 57:1, C.I. Pigment Red 122, C.I. Pigment Red 185, C.I. Pigment Yellow 12, C.I. Pigment Yellow 17, C.I. Pigment Yellow 1807 C.I. Pigment Yellow 97, C.I. Pigment Yellow 74, C.I. Pigment Blue 15:1 and C.I. Pigment Blue 15:3. Magnetic powder can also be used as the coloring agent. Examples of the magnetic powder include known magnetic materials such as ferromagnetic metals such as cobalt, iron, and nickel and alloys or oxides of a metal such as cobalt, iron, nickel, aluminum, lead, magnesium, zinc, and manganese.

These coloring agents may be used either singly or in combination. The content of the coloring agent is preferably 0.1 part by weight or greater but not greater than 40 parts by weight, more preferably 1 part by weight or greater but not greater than 30 parts by weight, per 100 parts by weight of the binder resin.

Toners of respective colors such has yellow toner, magenta toner, cyan toner and black toner can be obtained by selecting an appropriate coloring agent as needed.

No particular limitation is imposed on the other components and they may be selected as needed depending on the using purpose. Examples thereof include various known additives such as inorganic particles, charge controlling agent, and releasing agent.

Inorganic particles may be added to the toner of the exemplary embodiment if necessary. As the inorganic particles, known inorganic particles such as silica particles, titanium oxide particles, alumina particles, cerium oxide particles, and particles obtained by treating the above particles to have a hydrophobic surface may be used either singly or in combination. Of these, silica particles having a smaller refractive index than that of the binder resin are preferred from the standpoint of not impairing coloring properties and transparency such as the OHP transmission property. The silica particles may be subjected to various surface treatments. For example, those subjected to surface treatment with a silane coupling agent, a titanium coupling agent, or a silicone oil are preferred.

By the addition of these inorganic particles, the viscoelasticity of the toner may be adjusted or the image gloss or penetration into paper may be adjusted. The inorganic particles are added in an amount of preferably from 0.5 wt. % or greater but not greater than 20 wt. %, more preferably 1 wt. % or greater but not greater than 15 wt. % based on 100 parts by weight of the raw materials of the toner.

The charge controlling agent may be added to the toner of the exemplary embodiment if necessary. Examples of the charge controlling agent include chromium-based azo dyes, iron-based azo dyes, and aluminum-based azo dyes, and metallic complexes of salicylic acid.

The toner of the exemplary embodiment may contain a releasing agent. The releasing agent contained in the toner improves the releasing property in the fixing step. Use of it in the contact heating fixing system enables to reduce or remove a releasing oil to be applied to a fixing roll so that decrease in the life of a fixing roll or defects such as oil strain due to the releasing oil can be avoided, leading to cost reduction.

Specific examples of the releasing agent include low molecular weight polyolefins such as polyethylene, polypropylene, and polybutene, silicones having a softening temperature upon heating, fatty acid amides such as oleic acid amide, erucic acid amide, recinoleic acid amide, and stearic acid amide, vegetable waxes such as carnauba wax, rice wax, candelilla wax, wood wax, and jojoba oil, animal waxes such as beeswax, and mineral/petroleum waxes such as montan wax, ozokerite, ceresin, paraffin wax, microcrystalline wax, and Fischer-Tropsch wax.

The melting temperature Tmw of the releasing agent is preferably 50° C. or greater but not greater than 120° C., or about 50° C. or greater but not greater than about 120° C., more preferably not greater than the melting temperature of the binder resin. The melting temperatures within the above range enable to suppress toner filming further while maintaining the low-temperature fixing property of the toner. When the melting temperature Tmw of the releasing agent is less than 50° C., heat storage property cannot always be achieved. When it exceeds 120° C., the releasing property at low temperatures is not sufficient and low-temperature fixing property may be impaired.

These releasing agents may be used either singly or in combination.

The content of the releasing agent is preferably 1 part by weight or greater but not greater than 20 parts by weight, more preferably 2 parts by weight or greater but not greater than 15 parts by weight, based on 100 parts by weight of the raw materials of the toner. Addition of the releasing agent in an amount less than 1 part by weight may produce no effect. Addition of it in an amount exceeding 20 parts by weight, on the other hand, tends to have an adverse effect on the charging property. In addition, since the toner tends to be broken inside a developing machine, the releasing agent and the toner resin are spent to the carrier to lower the charge. Moreover, when a color toner is used, for example, oozing of it to the image surface tends to be insufficient and the releasing agent may remain in the image, resulting in deterioration of transparency.

<Production Method of Electrostatic-Charge-Developing Toner>

As the production method of the toner according to the exemplary embodiment, any of known production methods such as kneading grinding, suspension polymerization, solution suspension, and emulsion polymerization aggregation may be used, but the solution suspension method is preferably employed for it.

One example of the production method of a toner by using solution suspension will next be described.

[Mixture Preparation Step]

First, a mixture is prepared by dissolving or dispersing in an organic solvent a binder resin containing a crystalline polyester resin and an amorphous polyester resin and a coloring agent (mixture preparation step). In this mixture preparation step, a mixture of toner materials is obtained by dissolving or dispersing toner materials containing at least the binder resin and the coloring agent in an organic solvent.

The toner materials may contain, in addition to the binder resin and the coloring agent, a releasing agent or a charge controlling agent to be usually added to toner particles, if necessary. The mixture of the toner materials may be obtained by dissolving or dispersing in an organic solvent a kneaded mass obtained in advance by kneading the coloring agent and the releasing agent or charge controlling agent in the binder resin; by dissolving the binder resin in an organic solvent and then dispersing the coloring agent and the releasing agent, charge controlling agent, and the like in a media-containing disperser such as ball mill or sand mill or a high-pressure disperser; or by dispersing in an organic solvent the coloring agent and the releasing agent, charge controlling agent, or the like in advance by using a media-having disperser, high-pressure disperser, or a ultrasonic disperser and then dissolving the binder resin in the dispersion. In this mixing step, the mixture may be obtained by any method insofar as the binder resin is dissolved in an organic solvent and the coloring agent is dissolved or dispersed therein.

Examples of the organic solvent to be used for dissolving or dispersing the toner materials therein include ester solvents such as methyl acetate and ethyl acetate, ketone solvents such as methyl ethyl ketone and methyl isopropyl ketone, aliphatic hydrocarbon solvents such as hexane and cyclohexane, and halogenated hydrocarbon solvents such as dichloromethane, chloroform, and trichloroethylene. These organic solvents are preferably capable of dissolving therein the binder resin, have a water solubility of approximately 0 wt. % or greater but not greater than 30 wt. %, and have a boiling temperature of 100° C. or less. It is preferred not to use a polymerizable monomer such as styrene or acrylic acid. Use of ethyl acetate is especially preferred in view of safety upon working, cost, and productivity in industrialization of the toner. These organic solvents are preferably used to give the viscosity of the mixture of the toner materials to fall within a range of 1 mPa/s or greater but not greater than 10,000 mPa/s at 20° C., more preferably within a range of 1 mPa/s or greater but not greater than 2000 mPa/s. The above conditions can also be applied to an organic solvent which may be contained in a small amount in the final product of the toner.

In the mixture preparation step, it is preferred to add an isocyanate-containing polyester resin and an amine. This enables to improve the enclosing property of the releasing agent and suppress toner filming further.

[Suspension Preparation Step]

The mixture obtained in the mixture preparation step is then dispersed and suspended in an aqueous medium to prepare a suspension (suspension preparation step).

As the aqueous medium, a dispersion obtained by dispersing an inorganic dispersant in water is preferred. In order to obtain toner particles having an almost uniform particle size distribution, it is preferred to disperse an inorganic dispersant in water and at the same time, add a high-molecular dispersant soluble in water. The inorganic dispersant may be dispersed in water by using a media-containing disperser such as ball mill, a high-pressure disperser, or an ultrasonic disperser. Any method may be employed for adding the high-molecular dispersant insofar as it can dissolve the dispersant in water almost uniformly. Water used for dispersion is typically ion exchange water, distilled water, or pure water.

As the inorganic dispersant, a hydrophilic dispersant it preferred. Specific examples include silica, alumina, titania, calcium carbonate, magnesium carbonate, tricalcium phosphate, clay, diatomaceous earth, and bentonite. Of these, calcium carbonate is preferred. Of these, those having a particle surface coated with a carboxyl-containing polymer are more preferred. Since such a dispersant coated with a polymer optimizes a lipophilicity-hydrophilicity balance, coalescence of dispersed particles in the suspension preparation step of the mixture of the toner materials hardly occurs and toner particles having a sharp particle size distribution can be obtained.

Examples of the carboxyl-containing polymer include copolymers between an α,β-monoethylenically unsaturated carboxylate ester and an α,β-monoethylenically unsaturated carboxylic acid or at least one selected from alkali metal salts, alkaline earth metal salts, ammonium salts, and amine salts obtained by neutralizing the carboxyl group of an α,β-monoethylenically unsaturated carboxylic acid with an alkali metal, an alkaline earth metal, ammonium or amine; and alkali metal salts, alkaline earth metal salts, ammonium salts or amine salts of a copolymer between an α,β-monoethylenically unsaturated carboxylic acid and an α,β-monoethylenically unsaturated carboxylate ester. They may be used either singly or in combination.

The α,β-monoethylenically unsaturated carboxylic acid is typically at least one selected from α,β-unsaturated monocarboxylic acids such as acrylic acid, methacrylic acid, and crotonic acid and α,β-unsaturated dicarboxylic acids such as maleic acid, fumaric acid, and itaconic acid. Typical examples of the α,β-monoethylenically unsaturated carboxylate ester include alkyl esters of acrylic acid, methacrylic acid, or the like, acrylates or methacrylates having an alkoxy group, acrylates or methacrylates having a cyclohexyl group, acrylates or methacrylates having a hydroxyl group, polyalkylene glycol monoacrylates, and polyalkylene glycol monomethacrylates. Those selected from α,β-monoethylenically unsaturated carboxylate esters represented by them are preferred.

The inorganic dispersant has a volume-average particle size of preferably 1 nm or greater but not greater than 1,000 nm, more preferably 5 nm or greater but not greater than 500 nm, still more preferably 10 nm or greater but not greater than 300 nm. The inorganic dispersants having a volume average particle size less than 1 nm may be dispersed with difficulty, while those having a volume particle size exceeding 1,000 nm cannot easily maintain the dispersed state of an oil phase component stably due to a decrease in the difference from the toner particle size. The inorganic dispersant is used in an amount of preferably 1 part by weight but not greater than 300 parts by weight, more preferably 4 parts by weight or greater but not greater than 100 parts by weight based on 100 parts by weight of the toner. Amounts less than 1 part by weight may impair the dispersibility and stability. Amounts exceeding 300 parts by weight, on the other hand, may raise the viscosity of a water-phase component and deteriorate the stability of a dispersed suspension.

The high-molecular dispersant is preferably a hydrophilic one. Of the high-molecular dispersants having a carboxyl group, those having no lipophilic group such as hydroxypropoxyl group or methoxyl group are preferred. Specific examples include water soluble cellulose ethers such as carboxymethyl cellulose and carboxyethyl cellulose. Of these, carboxymethyl cellulose is especially preferred. Of these celluloses, those having an etherification degree of 0.6 or greater but not greater than 1.5 and an average polymerization degree of 50 or greater but not greater than 3,000 are preferred. The carboxyl group may be present in the form of a metal salt with sodium, potassium, magnesium or the like. The using amount of the high-molecular dispersant may be changed depending on the viscosity (differing with a ratio between the toner materials and organic solvent or the like) of the mixture of the toner materials in order to sharpen the particle size distribution of the toner particles. For example, when the viscosity of the mixture of the toner materials is relatively low, it is not necessary to raise the viscosity of the aqueous medium and at the same time, to use a large amount of the high-molecular dispersant. When the viscosity of the mixture of the toner materials is high, on the other hand, it is possible to increase the amount of the high-molecular dispersant and raise the viscosity of the aqueous medium. The viscosity of the aqueous medium at 20° C. is adjusted to fall within a range of preferably approximately 1 mPa/s or greater but not greater than 3,000 mPa/s, more preferably 1 mPa/s or greater but not greater than 1,000 mPa/s.

As the apparatus to be used in the suspension preparation step, commercially available ones as an emulsifier or a disperser are usable. Examples include batch-type emulsifiers such as "Ultra Turrax" (trade mark; product of IKA), "Polytron" (trade mark, product of Kinematica) 8 "TK Auto Homo Mixer" (trade mark; product of PRIMIX), and "National Cooking Mixer" (trade mark; product of Matsushita Electric Industrial); continuous emulsifiers such as "Ebara Milder" (trade mark, product of Ebara) "TK Pipeline Homo Mixer" and "TK Homomic Line Flow" (each, trade name; product of PRIMIX), "Colloid mill" (product of Shinko Pantec), slasher, trigonal wet-type grinding machine (product of Nippon Coke & Engineering), "Cavitron" (trade mark; product of Eurotec), and "Fine flow mill" (product of Pacific Machinery & Engineering); emulsifiers usable as both a batch type and continuous type such as "Clearmix" (trade mark; product of M Technique) and "Filmics" (trade mark; product of PRIMIX); high-pressure emulsifiers such as "Microfluidizer" (trade mark of Mizuho Industrial), "Nanomaker" and "Nanomizer" (trade mark; product of Nanomizer), and "APV Gaulin" (trade mark, product of Gaulin); membrane emulsifiers such as "Membrane emulsifier" (trade mark; product of REICA); oscillation type emulsifiers such as "Vibro mixer" (trade name; product of REICA), and ultrasonic emulsifiers such as "Ultrasonic homogenizer" (trade name; product of Branson).

[Solvent Removal Step]

Next, a toner dispersion is obtained by removing the organic solvent from the suspension obtained in the suspension preparation step (solvent removal step). In this solvent removal step, a toner dispersion is obtained by removing the organic solvent from the dispersed suspension obtained in the suspension preparation step. The toner dispersion prepared in this solvent removal step may be a liquid in which the toner materials, the inorganic dispersant, and the like have been dispersed and it is obtained without drying. The organic solvent removal from the suspension may be performed immediately after the suspension preparation step, but it is preferred to remove the organic solvent at least one minute after the completion of the suspension preparation step in order to stabilize the particle size distribution, thereby obtaining toner particles having a more uniform particle size distribution. In this solvent removal step, the organic solvent contained in the droplets of the suspension is removed preferably by cooling or heating the suspension obtained in the suspension preparation step within a temperature range of 0° C. or greater but not greater than 100° C. Either one of the following methods can be preferably employed for the removal of the organic solvent.

(1) Air is blown into the suspension to forcibly renew the gas phase on the surface of the suspension. In this case, a gas may be blown into the suspension.

(2) The pressure is reduced to, for example, 10 mmHg or greater but less than 760 mmHg. In this case, the gas phase on the surface of the suspension may be forcibly renewed by purging with a gas or moreover, a gas may be blown into the suspension.

When the inorganic dispersion stabilizer or the above organic dispersion stabilizer (high-molecular dispersant) attach to and remain on the surface of the toner thus obtained, hygroscopic property of the remnant may deteriorate the humidity dependence of the charge property or powder flowability of the toner. It is therefore preferred to remove the inorganic and organic dispersion stabilizers as much as possible in order to reduce the influence of them on the charge property or the powder flowability of the toner to the minimum. After removal of a small amount of the remaining solvent from the toner by drying, the toner thus obtained is preferably washed with an acid, such as hydrochloric acid, nitric acid, formic acid, or acetic acid, capable of dissolving the inorganic dispersion stabilizer. By this washing, the inorganic dispersion stabilizer remaining on the toner surface can be removed. The toner after acid treatment may be neutralized with an alkali such as sodium hydroxide if necessary. The toner may be collected by a proper method such as filtration, decantation or centrifugal separation as needed and then washed with water if necessary.

[Drying Step]

The toner dispersion obtained in the solvent removal step is then dried to obtain a toner (drying step). In this drying step, water and the like are removed from the toner dispersion obtained in the solvent removal step to obtain an electrostatic charge developing toner. In this drying step, time for reducing the water content of the toner to 3 wt. % or less is adjusted to preferably less than 10 minutes. Such rapid drying enables to prevent oozing out of the internal contaminant from the toner surface. It is preferred to employ a flash dryer as the drying machine and complete the drying within 30 seconds Although an apparatus used for this drying step is not particular limited, examples include commercially available dryers and drying machines.

When a flash dryer is used, drying is performed while setting the outlet temperature T0 of the flash dryer to 50° C. or greater but not greater than 150° C. in consideration of a drying efficiency. When a crystalline polyester resin (melting temperature Tmc) having a low melting temperature and an amorphous polyester resin (glass transition temperature Tg) are used, the following equations are preferably satisfied: Tg−5>T0>Tmc and T0>30. When the outlet temperature T0 is not greater than 30° C. or not greater than Tmc, the drying rate of the solvent components from the inside of the toner dispersion decreases so that drying does not proceed sufficiently and a drying effect does not appear smoothly. When the outlet temperature T0 of the flash dryer is (Tg−5)° C. or greater, on the other hand, the surface of the toner particles thus obtained become soft, tending to cause aggregation of the toner particles When the toner particles are treated at a further high temperature, the toner particles are fusion-bonded to the inner wall of the flash dryer or the inner wall of the nozzle thereof, making it difficult to treat them continuously.

The toner to be supplied to the flash dryer may be in any of the following forms; mud, mass or particulate. The water content in the toner to be supplied to the flash dryer is preferably within a range of 20 wt. % or greater but not greater than 95 wt %, or about 20 wt. % or greater but not greater than about 95 wt %. The water content in the toner to be supplied to the flash dryer falls within a range of preferably 0.01 wt. % or greater but not greater than 10 wt. %, or about 0.01 wt. % or greater but not greater than about 10 wt. %. The term "flash dryer" as used herein means an apparatus for dispersing a substance in any of the mud, mass or particulate form with an aid of an air stream, drying it and then pneumatically transporting it together with the air stream.

The production process may further include a step of removing a trace amount of remaining components such as the organic solvent of the toner and a step of sifting the toner to obtain an electrostatic-image-developing toner, if necessary. The organic solvent removal step and sifting step may be performed by using any method but a method not causing aggregation or fragmentation of the toner is preferred.

<Physical Properties of Electrostatic-Image-Developing Toner>

The volume-average particle size of the electrostatic-image-developing toner according to the exemplary embodiment is preferably 4 μm or greater but not greater than 8 μm, or about 4 μm or greater but not greater than about 8 μm, more preferably 5 μm or greater but not greater than 7 μm, or about 5 μm or greater but not greater than about 7 μm while the number-average particle size is preferably 3 μm or greater but not greater than 7 μm, more preferably 4 μm or greater but not greater than 6 μm.

The volume-average particle size and the number-average particle size are measured using "Coulter Multisizer II" (trade name; product of Beckman Coulter) at an aperture size of 100 μm. The measurement is carried out by dispersing the toner in an aqueous electrolyte solution (aqueous solution of ISOTON) and then ultrasonically dispersing for 30 seconds.

The volume-average particle size distribution index GSDv of the electrostatic-image-developing toner according to the exemplary embodiment is 1.27 or less, or about 1.27 or less, preferably 125 or less, or about 1.25 or less. When the GSDv exceeds 1.27, the particle size distribution does not become sharp and resolution lowers, which may lead to scattering of toner or image defects such as fogging.

The volume average particle size D50v and the volume average particle size distribution index GSDv are determined in the following manner. The volume and the number of toners in particle size range (channel) divided based on the particle size distribution of the toner measured by the above Coulter Multisizer II-type (product of Beckman Coulter) are each accumulated from the smaller particle size side to depict a cumulative distribution. The particle size when the cumulative percentage becomes 16% is defined as the volume-average particle size D16v or the number-average particle size D16p. The particle size when the cumulative percentage becomes 50% is defined as the volume-avearage particle size D50v or the number-average particle size D50p. In the same way, the particle size when the cumulative percentage becomes 84% is defined as the volume-average particle size D84v or the number-average particle size D84p. In this case, D80v represents a volume average particle size and the volume-average particle size distribution index (GSDv) is given by $(D84v/D16v)^{1/2}$. Herein, $(D84v/D16v)^{1/2}$ represents a number average particle size distribution index GSDp.

A shape factor SF1 of the electrostatic-image-developing toner according to the exemplary embodiment represented by the following equation is preferably 110 or greater but not greater than 140, or about 110 or greater but not greater than about 140, more preferably 115 or greater but not greater than 130, or about 115 or greater but not greater than about 130.

$$SF1=(ML^2/A)\times(\Pi/4)\times 100$$

wherein, ML and A represent the maximum length (μm) and the projected area ($\mu m^2$) of the toner, respectively. When the shape factor SF1 of the toner is smaller than 110 or over 140, charge properties, cleaning properties, or transfer properties cannot always be kept excellent for a long period of time.

The shape factor SF1 is measured as follows by using an image analyzing system ("Luzex FT", trade name; product of Nireco). A shape factor SF1 is determined by inputting optical microscopic images of toner particles spread on a slide glass into the Luzex image analyzing system via a video camera, measuring the maximum length (ML) and projected area (A) of 50 toner particles, calculating the shape factors of these particles in accordance with the following equation: $(ML^2/A)\times(\Pi/4)\times 100$, and averaging the calculated shape factors.

<Electrostatic Image Developer>

In the exemplary embodiment, no particular limitation is imposed on the electrostatic image developer insofar as it contains the electrostatic-image-developing toner of the exemplary embodiment and it may have a composition as needed depending on the using purpose. The electrostatic image developer in the exemplary embodiment is a one-part electrostatic image developer when the electrostatic-image-developing toner is used singly, while it is a two-part electrostatic image developer when the toner is used in combination with a carrier.

When a carrier is used, no particular limitation is imposed on the carrier. Carriers known per se in the art are usable. Examples include known carriers such as resin-coated carriers as described in JF-A-62-39879 and JP-A-56-11461.

Specific examples of the carriers include the following resin-coated carriers. The core particles of the carriers include common iron powders, ferrite, and magnetite products and a volume-average particle size thereof is approximately 30 μm or greater but not greater than 200 μm.

Examples of coating resins of the resin-coated carrier include homopolymers, e.g., styrenes such as styrene, p-chlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylics such as dimethylaminoethyl methacrylate; vinyl nitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; vinyl fluorine-containing monomers such as vinylidene fluoride, tetrafluoroethylene, and hexafluoroethylene; copolymers composed of two or more of these monomers; silicone resins containing methyl silicone, methyl phenyl silicone or the like; polyesters containing bisphenol, glycol or the like; epoxy resins, polyurethane resins, polyamide resins, cellulose resins, and polyether resins, polycarbonate resins. These resins may be used either singly or in combination. The coating amount of the coating resin is preferably approximately 0.1 part by weight or greater but not greater than 10 parts by weight, more preferably 0.5 part by weight or greater but not greater than 3.0 parts by weight based on 100 parts by weight of the core particles.

A heating-type kneader, a heating-type Henschel mixer, a UM mixer, or the like may be used for production of the carrier, and a heating-type rolling fluidized bed, heating-type kiln, or the like may also be used, depending on the amount of the coating resin.

Further, the mixing ratio of the electrostatic image developing toner of the exemplary embodiment and the carrier in the electrostatic image developer is not particularly limited, and may be selected depending on the using purpose as needed.

<Image Forming Apparatus>

The image forming apparatus according to the exemplary embodiment has an image holding member, a latent image forming unit for forming an electrostatic latent image an the surface of the image holding member, a developing unit for developing the electrostatic latent image with a developer to form a toner image, and a transfer unit for transferring the toner image thus developed to a transfer-receiving material and uses as a developer the above electrostatic image developer. The image forming apparatus according to the exemplary embodiment may have another unit, for example, a charging unit for charging the image holding member, a fixing unit for fixing the toner image transferred to the surface of the transfer-receiving material, and a cleaning unit for removing the toner remained on the surface of the image holding member.

A schematic view of one example of the image forming apparatus according to the exemplary embodiment is shown in FIG. 1. The constitution of the apparatus will hereinafter be described referring thereto. An image forming apparatus 1 is equipped with a charging portion 10, an exposure portion 12, an electrophotographic photoreceptor 14 serving as an image holding member, a developing portion 16, a transfer portion 18, a cleaning portion 20, and a fixing portion 22.

In the image forming apparatus 1, the electrophotographic photoreceptor 14 has therearound the following portions in the order of mention: the charging portion 10 serving as a charging unit for charging the surface of the electrophotographic photoreceptor 14, the exposing portion 12 serving as a latent image forming unit for exposing the charged electrophotographic photoreceptor 14 and forming an electrostatic latent image based on image information, the developing portion 16 serving as the developing unit for developing the electrostatic latent image with a toner to form a toner image, the transfer portion 18 serving as a transfer unit for transferring the toner image formed on the surface of the electrophotographic photoreceptor 14 to the surface of a transfer-receiving material 24, and a cleaning portion 20 serving as a cleaning unit for removing the toner remained on the surface of the electrophotographic photoreceptor 14 after transfer. In addition, a fixing portion 22 serving as a fixing unit for fixing the transferred toner image to the transfer-receiving material 24 is placed on the left side of the transfer portion 18.

The image forming apparatus 1 according to the present embodiment operates as follows. First, the surface of the electrophotographic photoreceptor 14 is uniformly charged by the charging portion 10 (Charging step). Then, light is irradiated to the surface of the electrophotographic photoreceptor 14 by the exposure portion 12, the charge is removed from the light irradiated portion, and an electrostatic image (electrostatic latent image) is formed in accordance with the image information (latent image forming step). The electrostatic image is developed by the developing portion 16 and a toner image is formed on the surface of the electrophotographic photoreceptor 14 (developing step). For example, in the case of a digital electrophotographic copying machine using an organic photoreceptor as the electrophotographic photoreceptor 14 and laser beam as the exposure portion 12, a negative charge is given to the surface of the electrophotographic photoreceptor 14 by the charging portion 10, a digital latent image in the dot form is formed by laser beam, and a toner is given to the portion exposed to laser beam by the developing portion 16 to visualize the image. In this case, a minus bias is applied to the developing portion 16. Next, in the transfer portion 18, a transfer-receiving material 24 such as paper is stacked on the toner image, a charge with a polarity contrary to that of the toner is given to the transfer-receiving material 24 from the reverse side of the transfer-receiving material 24, and the toner image is transferred to the transfer-receiving material 24 by using an electrostatic force (transfer step). Heat and pressure are applied to the toner image thus transferred at the fixing portion 22 by using a fixing member and it is fusion-bonded and fixed to the transfer-receiving material 24 (fixing step). The toner which has not been transferred and has remained on the surface of the electrophotographic photoreceptor 14 is removed at the cleaning portion 20 (cleaning step). A series of operations from charging to cleaning constitutes one image formation cycle. In FIG. 1, a toner image is transferred directly to the transfer-receiving material 24 such as paper at the transfer portion 18, but it may be transferred via a transfer member such as intermediate transfer material.

The charging unit, image holding member, exposure unit, developing unit, transfer unit, cleaning unit, and fixing unit in the image forming apparatus 1 illustrated in FIG. 1 will next be described, respectively.

(Charging Unit)

As the charging portion 10 serving as a charging unit, a charging apparatus such as corotron as illustrated in FIG. 1 is used. Alternatively, a conductive or a semi-conductive charging roll may be employed. A contact type charging apparatus using a conductive or semi-conductive charging roll may apply a direct current to the electrophotographic photoreceptor 14 or may apply superimposed alternating currents thereto. For example, by such a charging portion 10, discharge is excited in a minute space in the vicinity of the contact portion with the electrophotographic photoreceptor 14 to charge the surface of the electrophotographic photoreceptor 14. The surface of the photoreceptor 14 is charged typically at from −300V or greater but not greater than −1000V. The conductive or semi-conductive charging roll as described above may have either a single-layer structure or a multiple structure. The charging roll may be equipped with a mechanism of cleaning the surface thereof.

(Image Holding Member)

The image holding member has at least a function of having a latent image (electrostatic image) formed thereon. An electrophotographic photoreceptor is suited as the image holding member. The electrophotographic photoreceptor 14 has a coated film containing an organic photoreceptor on the peripheral surface of a cylindrical conductive substrate. The coated film is obtained by forming on the substrate an undercoat layer, if necessary, and a photosensitive layer including a charge generation layer containing a charge generation substance and a charge transport layer containing a charge transport substance in the order of mention. The stacking order of the charge generation layer and the charge transport layer may be reversed. The charge generation substance and the charge transport substance are incorporated in respective layers (charge generation layer and charge transport layer), followed by stacking to form a stack type photoreceptor. It may be a single-layer type photoreceptor obtained by incorporating both the charge generation substance and the charge transport substance in one layer. Of these, the stack type photoreceptor is preferred. An intermediate layer may be placed between the undercoat layer and photosensitive layer. Not only the organic photoreceptor but also another photoreceptor such as amorphous silicon photosensitive film may be used.

(Exposure Unit)

No particular limitation is imposed on the exposure portion 12 serving as an exposure unit and examples of it include optical apparatuses capable of forming a desired image on the surface of the image holding member by exposure to a light source such as semiconductor laser light, LED light, or liquid-crystal shutter light.

(Developing Unit)

The developing portion 16 serving as the developing unit has a function of forming a toner image by developing a latent image formed on the image holding member with a toner-containing developer. No particular limitation is imposed on such a developing apparatus insofar as it has the above function. It may be selected as needed, depending on the purpose. Examples include known developing apparatuses having a function of attaching an electrostatic-image-developing toner to the electrophotographic photoreceptor 14 with a brush, roller, or the like. For the electrophotographic photoreceptor 14, a direct-current voltage is usually applied, but superimposed AC voltage may be applied.

(Transfer Unit)

The transfer portion 18 serving as a transfer unit may be that giving a charge having a polarity reverse to that of the toner to the transfer-receiving material 24 from the back side of the transfer-receiving material 24 and transferring the toner image to the transfer-receiving material 24 with an electrostatic force as illustrated in FIG. 1 or a transfer roll and transfer roll pressing apparatus using a conductive or semi-conductive roll for directly contacting to the surface of the transfer-receiving material 24 via the transfer-receiving material 24 to transfer the toner image to the surface of the transfer-receiving material 24. As a transfer current to be applied to the image holding member, a direct current or a superimposed alternating current may be applied to the transfer roll. The transfer roll may be set as desired, depending on the width of an image region to be charged, shape of a transfer charger, opening width, process speed (peripheral speed), or the like. For cost reduction, a single-layer foamed roll is preferred as the transfer roll. The transfer system may be either a system of directly transferring to the transfer-receiving material 24 such as paper or a system of transferring to the transfer-receiving material 24 via an intermediate transfer material.

As the intermediate transfer material, known intermediate transfer materials may be used. Examples of materials used for the intermediate transfer material include polycarbonate resin (PC), polyvinylidene fluoride (PVDF), polyalkylene phthalate, blend of PC/polyalkylene terephthalate (PAT), and blends such as ethylene tetrafluoroethylene copolymer (ETFE)/PC, ETFE/PAT, and PC/PAT, Of these, an intermediate transfer belt using a thermosetting polyimide resin is preferred from the standpoint of mechanical strength.

(Cleaning Unit)

The cleaning portion 20 serving as a cleaning unit may be selected as needed from those employing a blade cleaning system, a brush cleaning system, or a roll cleaning system insofar as it cleans a residual toner from the image holding member. Of these, use of a cleaning blade is preferred. Examples of the material of the cleaning blade include urethane rubber, neoprene rubber, and silicone rubber. Of these, use of a polyurethane elastic material is preferred because it has excellent wear resistance. The cleaning portion 20 can be omitted when a toner having a high transfer efficiency is employed.

(Fixing Unit)

The fixing portion 22 serving as a fixing unit (image fixing apparatus) fixes the toner image transferred to the transfer-receiving material 24 by heating, application of pressure, or both heating and application of pressure. It is equipped with a fixing member.

(Transfer-Receiving Material)

Examples of the transfer-receiving material (paper) 24 to which the toner image is transferred include normal paper and OHP sheet used in electrophotographic copying machine and printer. In order to improve the smoothness on the surface of the image after fixing, the surface of the transfer-receiving material is preferably as smooth as possible. For example, normal paper having a surface coated with a resin or art paper for printing may be employed.

By using a developer containing the toner of the exemplary embodiments the background fogging and toner filming can be suppressed even if the developer is used in a high-speed (for example, processing speed of 200 nm/sec or greater but not greater than 500 mm/sec, 200 am/sec or greater but not greater than 250 mm/sec) image forming apparatus.

EXAMPLES

The invention will next be described more specifically by Examples and Comparative Examples. It should however be borne in mind that the invention is not limited to or by them.

<Preparation of Crystalline Polyester Resin A>

Crystalline polyester resin A is prepared by mixing 51 mol % of 1,3-propanediol, 49 mol % of suberic acid, and as a catalyst, 0.08 mol % of dibutyltin oxide in a flask, heating the resulting mixture to 220° C. under pressure-reduced atmosphere, and carrying out a dehydration condensation reaction for 6.5 hours. Crystalline polyester resin A thus obtained has a melting temperature Tmc (endothermic peak temperature) of 47° C. and an acid value AVc of 13.2 mgKOH/g.

The melting temperature Tmc (endothermic peak temperature) of the crystalline polyester resin is determined from a maximum peak measured in accordance with ASTMD 3418-8 by using a differential scanning calorimeter ("DSC60" trade name; product of Shimadzu, equipped with an automatic tangent line processing system) under the conditions of a heating rate of 10° C./min from room temperature to 150° C.

<Preparation of Crystalline Polyester Resin B>

Crystalline polyester resin B is prepared by mixing 52 mol % of pentanediol, 48 mol % of succinic acid, and as a catalyst, 0.08 mol % of dibutyltin oxide in a flask, heating the resulting mixture to 220° C. under pressure-reduced atmosphere, and carrying out a dehydration condensation reaction for 6 hours. Crystalline polyester resin 3 thus obtained has a melting temperature Tmc (endothermic peak temperature) of 32° C. and an acid value AVc of 9.6 mgKOH/g.

<Preparation of Crystalline Polyester Resin C>

Crystalline polyester resin C is prepared by mixing 51 mol % of 1,6-hexanediol, 49 mol % of pimeric acid, and as a catalyst 0.08 mol % of dibutyltin oxide in a flask, heating the resulting mixture to 220° C. under pressure-reduced atmosphere, and carrying out a dehydration condensation reaction for 6.5 hours. Crystalline polyester resin C thus obtained has a melting temperature Tmc (endothermic peak temperature) of 52° C. and an acid value AVc of 7.7 mgKOH/g.

<Preparation of Crystalline Polyester Resin D>

Crystalline polyester resin D is prepared by mixing 52 mol % of pentanediol, 48 mol % of glutaric acid, and as a catalyst, 0.08 mol % of dibutyltin oxide in a flask, heating the resulting mixture to 200° C. under pressure-reduced atmosphere, and carrying out a dehydration condensation reaction for 4 hours. Crystalline polyester resin D thus obtained has a melting temperature Tmc (endothermic peak temperature) of 22° C. and an acid value AVc of 12.2 mgKOH/g.

<Preparation of Crystalline Polyester Resin E>

Crystalline polyester resin E is prepared by mixing 52 mol % of hexanediol, 48 mol % of glutaric acid, and as a catalyst, 0.08 mol % of dibutyltin oxide in a flask, heating the resulting mixture to 210° C. under pressure-reduced atmosphere, and carrying out a dehydration condensation reaction for 4 hours. Crystalline polyester resin E thus obtained has a melting temperature Tmc (endothermic peak temperature) of 28° C. and an acid value AVc of 12.0 mgKOH/g.

<Preparation of Amorphous Polyester Resin F>

A reaction vessel equipped with a stirrer, a thermometer, a capacitor, and a nitrogen gas inlet tube is charged with 23 mol % of dimethyl terephthalate, 10 mol % of isophthalic acid, 15 mol % of dodecenylsuccinic anhydride, 3 mol % of trimellitic anhydride, 5 mol % of bisphenol A ethylene oxide adduct, and 45 mol % of bisphenol A propylene oxide adduct. After the reaction vessel is purged with a dry nitrogen gas, 0.06 mol % of dibutyltin oxide is added as a catalyst. The resulting mixture is reacted by stirring at about 190° C. for about 7 hours in a nitrogen gas stream. After the temperature is raised to about 250° C. and the reaction is performed for about 5.0 hours by stirring, the pressure in the reaction vessel is reduced to 10.0 mmHg. Under reduced pressure, the stirring reaction is performed for about 0.5 hour to obtain Amorphous polyester resin F. Amorphous polyester resin F thus obtained has a glass transition temperature (Tg) of 55° C. It has a weight average molecular weight (Mw) of 21,200 and the resin has an acid value AVa of 15.2 mgKOH/g.

The glass transition temperature Tg of Amorphous polyester resin F is determined by measuring using a differential scanning calorimeter ("DSC3110", trade name; product of Mac Science, thermoanalysis system 001) under the conditions of a heating rate of 10° C./min from 0 to 150° C.

<Preparation of Ketimine Compound>

A reaction vessel equipped with a stirring rod and a thermometer is charged with 180 parts by weight of isophoronediamine and 70 parts by weight of methyl ethyl ketone. A reaction is effected at 53° C. for 4.5 hours to obtain a ketimine compound. The ketimine compound thus obtained has an amine value of 430 mgKOH/g.

<Preparation of an Isocyanate-Containing Polyester Prepolymer>

A reaction tank equipped with a cooling tube, a stirrer, and a nitrogen inlet tube is charged with 724 parts by weight of an adduct of bisphenol A with 2 mols of ethylene oxide, 100 parts by weight of 1,4-cyclohexanedicarboxylic acid, 200 parts by weight of phthalic anhydride, 1 part by weight of dodecylbenzenesulfonic acid, and 2 parts by weight of butyltin oxide. The resulting mixture is reacted at 140° C. for 15 hours. After cooling to 80° C., the reaction mixture is reacted with 150 parts by weight of isophorone diisocyanate in ethyl acetate for 2 hours to obtain a polyester prepolymer having, at an end thereof, an isocyanate group.

Example 1

<Preparation of Toner Mother Particles>

[Mixture Preparation Step]

In a Henschel mixer, 9 parts by weight of a coloring agent (phthalocyanine pigment, "PV FAST BLUE" trade name; product of Dainichiseika Color & Chemicals) and 73.5 parts by weight of Amorphous polyester resin F are mixed. The resulting mixture is kneaded in a pressure kneader, followed by grinding with a hammer mill. Separately, a reaction vessel is charged with 7 parts by weight of a releasing agent (paraffin wax, "HNP 9" trade name; product of Nippon Seiro, melting temperature Tmw: 77° C.) and 10.5 parts by weight of Crystalline polyester resin B. Further, ethyl acetate is added in an amount of three times (45 parts by weight) as much as that of Crystalline polyester resin B. The resulting mixture is heated at 50° C. to disperse and semi-dissolve it, followed by mixing in a homogenizer to obtain a solution. The ground product and the solution are mixed. After 47 parts by weight of the isocyanate-containing polyester prepolymer is added and the resulting mixture is mixed and dissolved in a homogenizer, 3 parts by weight of the ketimine compound is added. The resulting mixture is mixed in a homogenizer to obtain a solution of the raw materials.

The solution of the raw materials (150 parts by weight) is transferred to a vessel and the coloring agent and releasing agent are dispersed under the conditions of a liquid feed rate of 1 kg/hour, disc peripheral speed of 6 m/sec, and three passes in a ultra visco mill (product of AIMEX), which is a beads mill, filled with 80 vol. % of zirconium beads having a diameter of 0.5 mm. The solid concentration of the resulting mixture as measured under the conditions of 130° C. and 30 minutes is 50 wt %.

[Suspension Preparation Step]

Aqueous phase 1 is obtained by mixing 40 parts by weight of an inorganic dispersant (calcium carbonate, "Luminus" product of Maruo Calcium) with 300 parts by weight of ion exchange water. After 490 parts by weight of the resulting mixture is mixed in a TK homomixer (product of PRIMIX) for 1 minute at 5,000 rpm, 1,200 parts by weight of Aqueous phase 1 is added. The resulting mixture is mixed in a TX homomixer at 13,000 rpm for 20 minutes to obtain an emulsified slurry (suspension).

[Solvent Removing Step]

The resulting emulsified slurry is charged in a vessel equipped with a stirrer and a thermometer. After removing the solvent at 30° C. for 8 hours, the residue is aged at 45° C. for 4 hours to obtain a dispersed slurry (toner dispersion). The toner particles in the dispersed slurry have a volume average particle size and number average particle size, each measured using "Coulter Multisizer II" (trade name; product of Beckman Coulter), of 5.8 μm and 5.65 μm, respectively.

[Cleaning Step]

After 100 parts by weight of the dispersed slurry is filtered under reduced pressure, 100 parts by weight of ion exchange water is added to the filtered cake. The resulting mixture is mixed in a TK homomixer at 12,000 rpm for 10 minutes and then filtered. To the filtered cake thus obtained is added 10 wt. % of hydrochloric acid to adjust its pH to 2.8. After mixing in the TK homomixer at 12,000 rpm for 10 minutes, the resulting mixture is filtered. To the filtered cake thus obtained is added 500 parts by weight of ion exchange water. After the resulting mixture is mixed in the TX homomixer at 12,000 rpm for 10 minutes, a filtering operation is performed twice to obtain a final filtrated cake.

[Drying Step]

Using a flash jet dryer ("FJD-2" trade name; product of Seishin Enterprise), the filtered cake is then dried to obtain toner mother particles. The outlet temperature T0 of the flash Det dryer is set at 40° C.

<Preparation of Toner>

To 100 parts by weight of the resulting toner mother particles is added 1 part by weight of silica particles. The resulting mixture is charged in a 5-L Henschel mixer (FM5C) manufactured by Nippon Coke & Engineering and externally mixed to obtain Toner 1 having a volume average particle size of 6.1 μm. As the silica particles, particles obtained by the sol-gel process, made hydrophobic with HMDS (hexamethyldisilazane), and having a volume-average particle size of 110 nm are employed.

<Preparation of carrier>

| | |
|---|---|
| Ferrite particles (volume-average particle size of 35 μm) | 100 parts by weight |
| Toluene | 14 parts by weight |
| Perfluoroacrylate copolymer (critical surface tension: 24 dyn/cm) | 1.6 parts by weight |
| Carbon black ("VXC-72" trade name, product of Cabot, resistance: 100 Ωcm or less) | 0.12 part by weight |
| Crosslinked melamine resin particles (volume-average particle size: 0.3 μm, insoluble in toluene) | 0.3 part by weight |

The above components other than the ferrite particles are dispersed with a stirrer for 10 minutes to prepare a resin-coating-layer forming solution. The resulting resin-coating-layer forming solution and the ferrite particles are charged in a vacuum deaeration type kneader. After starring at 60° C. for 30 minutes, pressure is reduced to distill off toluene and form a resin coating layer to obtain a carrier It is to be noted that carbon black diluted in toluene is dispersed in advance in the perfluoroacrylate copolymer serving as a coating resin in a sand mill.

<Preparation of Developer>

The toner thus prepared is mixed with the carrier to obtain Developer 1.

<Measuring Method of the Content of Crystalline Polyester Resin in Toner>

The content of the crystalline polyester resin in the toner is determined using a differential scanning calorimeter ("DSC 60" trade name; product of Shimadzu, equipped with an automatic tangent line processing system) based on the endotherm in the melting temperature region in accordance with the ASTM method assuming that the endotherm of the same amount of the crystalline polyester resin is 100.

<Measuring Method of the Melting Temperature Tmc of Crystalline Polyester Resin, Glass Transition Temperature Tg of Amorphous Polyester Resin, and Melting Temperature Tmw of Releasing Agent in Toner>

The melting temperature Tmc of the crystalline polyester resin, the glass transition temperature Tg of the amorphous polyester resin, and the melting temperature Tmw of the releasing agent in the toner are determined using a differential scanning calorimeter ("DSC 60" trade name; product of Shimadzu, equipped with an automatic tangent line processing system) while measuring an endothermic peak by the ASTM method.

<Measuring Method of Acid Value AVc of Crystalline Polyester Resin and Acid Value AVa of Amorphous Polyester Resin in Toner>

First, an acid value of toner particles is measured. After 0.1 g of toner particles is weighed accurately, they are dissolved in 80 mL of tetrahydrofuran. Phenolphthaleine is added as an indicator and titration is performed using a 0.1N KOH ethanol solution. The solution is added until the end point where the color of the solution is maintained for 30 seconds. An acid value is calculated from the consumption amount of the 0.1N KOH ethanol solution. The acid value AVc of the crystalline polyester resin in the toner is calculated in a similar manner to that employed for the toner after fixing to OHP and then melting and separating the crystalline polyester resin at 60° C. The acid value AVa of the amorphous polyester resin is calculated from the acid value of the entire toner and the content and the acid value of the crystalline polyester resin.

(Evaluation)

<Evaluation of Toner Filming>

By using a modified model of "Docu Centre Color f450" (trade name; product of Fuji Xerox) (modified to adjust the processing speed to 450 nm/sac so as to operate similarly to the conventional machine until the transfer step even if a fixing unit is removed) and setting a toner amount on a recording medium ("Paper P" product of Fuji Xerox) to 0.3 g/m$^2$, printing is conducted to give 1,000 copies. The toner amount is then changed to 4.5 g/m$^2$ and printing is conducted to give 500 copies at a 50% toner amount. Of the 500 copies, the number of copies when an image defect due to toner filming has occurred is indicated by percentage. The toner filming is evaluated in accordance with the following criteria. The results are shown in Table 1. In the following criteria, grades A to C are within an acceptable level.

A: Percentage occurrence of image defects: less than 0.5%.

B: Percentage occurrence of image defects: 0.5% or greater but less than 1.0%.

C: Percentage occurrence of image defects; 1.0% or greater but less than 5.0%.

D: Percentage occurrence of image defects: 5.0% or greater.

<Evaluation of Background Fogging>

A developer is filled in the developing unit of "Docu Centre Color f450" (trade name; product of Fuji Xerox) and 5,000 copies of a mixed chart of a solid image and a letter are printed continuously under the circumstance of 30° C. and 85% RH and conditions of a processing speed of 220 mm/sec. The fixed image on the final print is evaluated in accordance with the following criteria. The results are shown in Table 1. Of the results, Grades A to C are within an acceptable level.

A: The image has almost no fogging.

B: The image has some fogging but not so apparent.

C; The image is inferior to B and has apparent fogging partially, which, in some cases, poses a problem in practical use.

D: The image has fogging all over the surface and poses a problem in practical use.

<Evaluation of Low-Temperature Fixing Property>

A developer is filled in the developing unit of a modified model of "Docu Centre Color f450" (trade name; product of Fuji Xerox) from which the fixing unit has been removed and an unfixed image is collected. A solid image of 40 mm×50 mm, a toner amount of 1.5 mg/cm$^2$, and Paper a (product of Fuji Xerox) as recording paper are employed. Then, the fixing unit of: "Docu Print C2220" is modified so that the fixing temperature can be changed. The low-temperature fixing property of an image is evaluated while raising the fixing temperature by 5° C. from 100° C. to 200° C. A fixed image which is free from image deficiency due to poor release and is therefore good is folded for 10 seconds by using a weight of 40 g/cm$^2$ and the fixing temperature at which the maximum width of the image deficiency of the folded portion becomes 0.3 mm or less is designated as the lowest fixing temperature and used as an indicator of the low-temperature fixing property. Temperatures not greater than 120° C. are within an acceptable level.

<Synthetic Evaluation>

Synthetic evaluation is performed in accordance with the following criteria. The results are shown in Table 1.

A: Excellent.

B: A little inferior to A but usable without problem.

C; Inferior to B and in spite of having some problems in practical user within an acceptable level.

D: Not suited for use because of problems in practical use.

Example 2

Developer 2 is obtained in a similar manner to Example 1 except that the amounts of Crystalline polyester resin B and Amorphous polyester resin F are changed to 7.5 parts by weight and 76.5 parts by weight, respectively. Developer 2 is evaluated as in Example 1. The results are shown in Table 1.

Example 3

Developer 3 is obtained in a similar manner to Example 1 except that the amounts of Crystalline polyester resin B and Amorphous polyester resin F are changed to 13.5 parts by weight and 70.5 parts by weight, respectively. Developer 3 is evaluated as in Example 1. The results are shown in Table 1.

Example 4

Developer 4 is obtained in a similar manner to Example 1 except for the use of Crystalline polyester resin E instead of Crystalline polyester resin B. Developer 4 is evaluated as in Example 1. The results are shown in Table 1.

Example 5

Developer 5 is obtained in a similar manner to Example 1 except for the use of Crystalline polyester resin A instead of Crystalline polyester resin B. Developer 5 is evaluated as in Example 1. The results are shown in Table 1.

Example 6

Developer 6 is obtained in a similar manner to Example 1 except that the amounts of Crystalline polyester resin B and Amorphous polyester resin F are changed to 4.5 parts by weight and 79.5 parts by weight, respectively. Developer 6 is evaluated as in Example 1. The results are shown in Table 1.

Example 7

Developer 7 is obtained in a similar manner to Example 1 except that the amounts of Crystalline polyester resin B and Amorphous polyester resin F are changed to 22.5 parts by weight and 61.5 parts by weight, respectively. Developer 7 is evaluated as in Example 1. The results are shown in Table 1.

Example 8

Developer 8 is obtained in a similar manner to Example 1 except that the amounts of the isocyanate-containing polyester prepolymer, the ketimine compound, and Amorphous polyester resin F are changed to 12.7 parts by weight, 0.8 part by weight, and 110 parts by weight, respectively. Developer 8 is evaluated as in Example 1. The results are shown in Table 1.

Example 9

Developer 9 is obtained in a similar manner to Example 1 except that the amounts of the isocyanate-containing polyester prepolymer, the ketimine compound, and Amorphous polyester resin F are changed to 15.5 parts by weight, 1.0 part by weight, and 107 parts by weight, respectively. Developer 9 is evaluated as in Example 1. The results are shown in Table 1.

Example 10

Developer 10 is obtained in a similar manner to Example 1 except that the amounts of the isocyanate-containing polyester prepolymer, the ketimine compound, and Amorphous polyester resin F are changed to 19.7 parts by weight, 1.3 parts by weight, and 102.5 parts by weight, respectively. Developer 10 is evaluated as in Example 1. The results are shown in Table 1.

Example 11

Developer 11 is obtained in a similar manner to Example 1 except that the amounts of the isocyanate-containing polyester prepolymer, the ketimine compound, and Amorphous polyester resin F are changed to 22. 6 parts by weight, 1.4 parts by weight, and 99.5 parts by weight, respectively. Developer 11 is evaluated as in Example 1. The results are shown in Table 2.

Example 12

Developer 12 is obtained in a similar manner to Example 1 except that the amounts of the isocyanate-containing polyester prepolymer, the ketimine compound, and Amorphous polyester resin F are changed to 55 parts by weight, 3.5 parts by weight, and 65 parts by weight, respectively. Developer 12 is evaluated as in Example 1. The results are shown in Table 2.

Example 13

Developer 13 is obtained in a similar manner to Example 1 except that the amounts of the isocyanate-containing polyester prepolymer, the ketimine compound, and Amorphous polyester resin F are changed to 59.2 parts by weight, 3.8 parts by weight, and 60.5 parts by weight, respectively. Developer 13 is evaluated as in Example 1. The results are shown in Table 2.

Example 14

Developer 14 is obtained in a similar manner to Example 1 except that the amounts of the isocyanate-containing polyester prepolymer, the ketimine compound, and Amorphous polyester resin F are changed to 67.7 parts by weight, 4.3 parts by weight, and 51.5 parts by weight, respectively. Developer 14 is evaluated as in Example 1. The results are shown in Table 2.

Example 15

Developer 15 is obtained in a similar manner to Example 1 except that the amounts of the isocyanate-containing polyester prepolymer, the ketimine compound, and Amorphous polyester resin F are changed to 73.3 parts by weight, 4.7 parts by weight, and 45.5 parts by weight, respectively. Developer 15 is evaluated as in Example 1. The results are shown in Table 2.

Example 16

Developer 16 is obtained in a similar manner to Example 1 except for the omission of the prepolymer and the ketimine compound. Developer 16 is evaluated as in Example 1. The results are shown in Table 2.

Comparative Example 1

Developer 17 is obtained in a similar manner to Example 1 except that the amounts of Crystalline polyester resin B and Amorphous polyester resin F are changed to 24 parts by weight and 60 parts by weight, respectively. Developer 17 is evaluated as in Example 1. The results are shown in Table 2.

Comparative Example 2

Developer 18 is obtained in a similar manner to Example 1 except that the amounts of Crystalline polyester resin B and Amorphous polyester resin F are changed to 3 parts by weight and 81 parts by weight, respectively. Developer 18 is evaluated as in Example 1. The results are shown in Table 2.

Comparative Example 3

Developer 19 is obtained in a similar manner to Example 1 except for the use of Crystalline polyester resin C instead of Crystalline polyester resin B. Developer 19 is evaluated as in Example 1. The results are shown in Table 2.

Comparative Example 4

Developer 20 is obtained in a similar manner to Example 1 except for the use of Crystalline polyester resin D instead of Crystalline polyester resin B. Developer 20 is evaluated as in Example 1. The results are shown in Table 2.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| Crystalline polyester resin Tmc [° C.] | 32 | 32 | 32 | 28 | 47 | 32 | 32 | 32 | 32 | 32 |
| Kind of crystalline polyester resin | B | B | B | E | A | B | B | B | B | B |
| Amount of crystalline polyester resin [wt. %] | 7 | 5 | 9 | 7 | 7 | 3 | 15 | 7 | 7 | 7 |
| Urea-modified polyester resin [wt. %] | 33.3 | 33.3 | 33.3 | 33.3 | 33.3 | 33.3 | 33.3 | 9 | 11 | 14 |
| Volume-average particle size of toner [μm] | 6.4 | 6.5 | 6.4 | 6.3 | 6.5 | 6.3 | 6.5 | 7.1 | 7 | 7 |
| Kind of developer | 1 | 2 | 3 | 4 | 5 | 6 | 7 | 8 | 9 | 10 |
| Evaluation of filming | A | A | A | B | C | A | C | C | B | B |
| Fogging | A | A | A | B | B | A | C | B | B | B |
| Lowest fixing temperature [° C.] | 110 | 115 | 110 | 110 | 115 | 120 | 105 | 100 | 105 | 105 |
| Synthetic evaluation | A | A | A | B | C | C | C | C | B | B |

TABLE 2

| | Ex. 11 | Ex. 12 | Ex. 13 | Ex. 14 | Ex. 15 | Ex. 16 | Comp. Ex. 1 | Comp. Ex. 2 | Comp. Ex. 3 | Comp. Ex. 4 |
|---|---|---|---|---|---|---|---|---|---|---|
| Crystalline polyester resin Tmc [° C.] | 32 | 32 | 32 | 32 | 32 | 32 | 32 | 32 | 52 | 22 |
| Kind of crystalline polyester resin | B | B | B | B | B | B | B | B | C | D |
| Amount of crystalline polyester resin [wt. %] | 7 | 7 | 7 | 7 | 7 | 7 | 16 | 2 | 7 | 7 |
| Urea-modified polyester resin [wt. %] | 16 | 39 | 42 | 48 | 52 | None | 33.3 | 33.3 | 33.3 | 33.3 |
| Volume-average particle size of toner [μm] | 6.7 | 6.6 | 6.8 | 7.3 | 7.5 | 6.3 | 6.5 | 6.6 | 6.5 | 6.5 |
| Kind of developer | 11 | 12 | 13 | 14 | 15 | 16 | 17 | 18 | 19 | 20 |
| Evaluation of filming | A | A | A | A | B | C | D | B | C | D |
| Fogging | A | A | B | B | C | C | D | A | B | D |

TABLE 2-continued

| | Ex. 11 | Ex. 12 | Ex. 13 | Ex. 14 | Ex. 15 | Ex. 16 | Comp. Ex. 1 | Comp. Ex. 2 | Comp. Ex. 3 | Comp. Ex. 4 |
|---|---|---|---|---|---|---|---|---|---|---|
| Lowest fixing temperature [° C.] | 105 | 110 | 115 | 120 | 120 | 100 | 110 | 125 | 125 | 100 |
| Synthetic evaluation | A | A | B | B | C | C | D | D | D | D |

As is apparent from Tables 1 and 2, the toners prepared in Examples to 16 can suppress toner filming even when used in a high-speed image forming apparatus while keeping the low-temperature fixing property. In addition, they produce good results in the evaluation of background fogging.

What is claimed is:

1. An electrostatic-image-developing toner comprising:

a binder resin that contains a crystalline polyester resin and an amorphous polyester resin; and a coloring agent, wherein the crystalline polyester resin has a melting temperature Tmc of from 25° C. to 32° C., and a content of the crystalline polyester resin in the electrostatic-image-developing toner is about 3 wt. % or greater but not greater than about 15 wt. %.

2. The electrostatic-image-developing toner according to claim 1, wherein the binder resin further contains a urea-modified polyester resin.

3. The electrostatic-image-developing toner according to claim 2, wherein the urea-modified polyester resin is obtained by a reaction between a polyester resin containing an isocyanate group and an amine.

4. The electrostatic-image-developing toner according to claim 1, wherein the crystalline polyester resin has an acid value AVc of about 5 mgKOH/g or greater but not greater than about 20 mgKOH/g.

5. The electrostatic-image-developing toner according to claim 1, wherein the crystalline polyester resin has a weight average molecular weight (Mw) of about 10,000 or greater but not greater than about 30,000.

6. The electrostatic-image-developing toner according to claim 1, wherein the amorphous polyester resin has an acid value AVa of about 10 mgKOH/g or greater but not greater than about 20 mgKOH/g.

7. The electrostatic-image-developing toner according to claim 1, wherein the amorphous polyester resin has a weight average molecular weight (Mw) of about 10,000 or greater but not greater than about 50,000.

8. The electrostatic-image-developing toner according to claim 1, wherein the amorphous polyester resin has a glass transition temperature (Tg) of about 40° C. or greater but not greater than about 60° C.

9. The electrostatic-image-developing toner according to claim 3, wherein an [NCO]/[OH] equivalent ratio is about 1/1 or greater but not greater than about 5/1 wherein [NCO] represents the isocyanate group and [OH] represents a hydroxyl group of the polyester resin.

10. The electrostatic-image-developing toner according to claim 1, further comprising a releasing agent that has a melting temperature Tmw of about 50° C. or greater but not greater than about 120° C.

11. The electrostatic developing toner according to claim 1, which has a volume average particle size of about 4 μm or greater but not greater than about 8 μm.

12. The electrostatic-image-developing toner according to claim 1, which has a volume average particle size distribution index GSDv of about 1.27 or less.

13. The electrostatic-image-developing toner according to claim 1, which has a shape factor SF1 of about 110 or greater but not greater than about 140.

14. The electrostatic-image-developing toner according to claim 1, which has a water content of about 0.01 wt. % or greater but not greater than about 10 wt. %.

15. An electrostatic image developer comprising:

the electrostatic-image-developing toner as claimed in claim 1; and a carrier.

* * * * *